US006993989B2

(12) United States Patent
Oomura et al.

(10) Patent No.: US 6,993,989 B2
(45) Date of Patent: Feb. 7, 2006

(54) STARTING APPARATUS

(75) Inventors: Tomohiro Oomura, Toyota (JP); Kazuo Hirama, Obu (JP); Mitsuhiro Murata, Niwa-gun (JP); Tatsuya Saitou, Kariya (JP); Hiroshi Kaneda, Kariya (JP); Shinji Usami, Okazaki (JP)

(73) Assignee: Denso Corporation, Kariya (JP)

( * ) Notice: Subject to any disclaimer, the term of this patent is extended or adjusted under 35 U.S.C. 154(b) by 132 days.

(21) Appl. No.: 10/419,773

(22) Filed: Apr. 22, 2003

(65) Prior Publication Data

US 2003/0200826 A1 Oct. 30, 2003

(30) Foreign Application Priority Data

Apr. 26, 2002 (JP) ..... 2002-125979
Dec. 13, 2002 (JP) ..... 2002-363019
Dec. 13, 2002 (JP) ..... 2002-363023

(51) Int. Cl.
*F16D 3/52* (2006.01)
*F16D 3/56* (2006.01)
*F16D 3/64* (2006.01)
*F01L 13/08* (2006.01)

(52) U.S. Cl. ..... 74/7 E; 74/7 R; 74/6; 464/73; 464/88; 464/92; 123/182.1

(58) Field of Classification Search ..... 74/6, 74/7 A, 7 R, 7 E; 123/182.1; 464/73, 76, 464/87, 88, 92
See application file for complete search history.

(56) References Cited

U.S. PATENT DOCUMENTS 3,884,049 A * 5/1975 Pauli ..... 464/73
4,561,316 A 12/1985 Bolz et al.
4,680,979 A * 7/1987 Morishita et al. ..... 74/7 E
5,323,663 A 6/1994 Ohgi et al.
5,688,203 A * 11/1997 Yamamoto et al. ..... 475/331
5,905,309 A * 5/1999 Ohmi et al. ..... 290/36 R
6,142,028 A * 11/2000 Soh ..... 74/7 C
6,490,940 B1 * 12/2002 Izquierdo et al. ..... 74/7 E
6,619,145 B2 * 9/2003 Hosoya ..... 74/7 E

FOREIGN PATENT DOCUMENTS

JP Y2 2-31581 8/1990
JP Y2 2-31583 8/1990

* cited by examiner

*Primary Examiner*—Marcus Charles
*Assistant Examiner*—Colby Hansen
(74) *Attorney, Agent, or Firm*—Oliff & Berridge, PLC

(57) ABSTRACT

A starting apparatus includes a drive motor and a reduction gear having a planetary gear for starting an engine by the drive motor via the reduction gear. An internal gear of the reduction gear includes a locking projection projecting in an axial direction. A rotation restricting member is formed with a guide groove in which the locking projection is loosely received and guided in a circumferential direction. A shock absorbing member is held in the guide groove in a state of being elastically in close contact with the locking projection in the circumferential direction. Thus, shock load to the internal gear is alleviated from the start.

20 Claims, 9 Drawing Sheets

STARTING APPARATUS

CROSS REFERENCE TO RELATED APPLICATION

This application is based on Japanese Patent Applications No. 2002-125979 filed on Apr. 26, 2002, No. 2002-363019 filed on Dec. 13, 2002 and No. 2002-363023 filed on Dec. 13, 2002, the disclosure of which are incorporated herein by reference.

FIELD OF THE INVENTION

The present invention relates to a starting apparatus used to start an engine. More specifically, the present invention relates to a starting apparatus having a reduction gear with a planetary gear.

BACKGROUND OF THE INVENTION

An internal combustion engine (hereinafter, simply referred to as "engine") needs to be driven by a starting apparatus (hereinafter, pertinently referred to as "starter") in starting the engine. As the starting apparatus, there are a gear type starter, a belt type starter and the like all of which are common in that an electric motor constitutes a drive source.

In starting the engine, comparatively large torque is required although depending on a kind and a displacement thereof. Therefore, when the engine is cranked directly by the motor, the physical configuration of the motor naturally becomes large. Hence, in a recent starting apparatus requesting light-weighted compact formation, high torque necessary for starting is achieved by interposing a reduction gear between the motor and the engine to thereby increase a speed reducing ratio.

Although there are various reduction gears, a planetary gear-type reduction gear, which compactly achieves a large speed reducing ratio, is frequently used. In the planetary-type reduction gear, a driving force inputted from the motor to a sun gear of the reduction gear is outputted from a carrier supporting planetary gears with high torque. In this case, rotation of an internal gear, which meshes with the planetary gears, in the circumferential direction is restricted to achieve a predetermined speed reducing ratio. That is, a large reaction force (torque) produced in accordance with the output needs to be received by the internal gear. Therefore, rotation of the internal gear in the circumferential direction needs to be constrained.

Meanwhile, according to the engine, torque necessary for rotation is rapidly varied by strokes of intake, compression and the like and an engine rotation speed is also pulsated. The motor of the starter cannot well follow such a load variation or the like and therefore, impact load is applied between the internal gear and a rotation restricting portion thereof. Further, the reaction force applied to the internal gear is not constant. As a result, unpleasant sound is likely to be caused in starting the engine due to vibration or the like of the internal gear by simply constraining the internal gear.

When the internal gear is rigidly restricted here, it is required to reinforce the internal gear or the restricting portion to be able to withstand the shock load, which hampers light-weighted compact formation of the starter. Hence, in order to alleviate the shock load applied to the internal gear and the like, a shock absorbing member including an elastic body made of such as rubber is provided between the internal gear and the rotation restricting portion. These are proposed in, for example, JP-Y2-2-31581, JP-Y2-2-31583, JP-B2-4-40549 (U.S. Pat. No. 4,561,316), and JP-A-5-52166 (U.S. Pat. No. 5,323,663).

For example, according to JP-Y2-2-31581, JP-Y2-2-31588 and JP-B2-4-40549, the shock absorbing member is for example provided on an outer peripheral side of an internal gear. However, an outer diameter of a reduction gear is increased thereby and compact formation of a starter is not achieved.

According to JP-A-5-52166, a projection extending from a side face of an internal gear in an axial direction is held by a shock absorbing member (elastic body) and therefore, in this case, a starter is not enlarged in an outer diameter direction. However, the projection of the internal gear is not held elastically by the shock absorbing member from the start. Therefore, shock load is not necessarily alleviated sufficiently from start of operation thereof. Particularly, in the case in which the internal gear and the like are made of synthetic resin in view of light-weighted and low coast formation or the like, when shock load is insufficiently alleviated, reliability of the internal gear and therefore, the starter can be lessened.

Further, in JP-A-5-52166, a friction plate is separately pressed to a pivoting plate engaged with the internal gear and the internal gear is constricted by friction force produced therebetween. Therefore, the structure of the starting apparatus is complicated.

Also, the shock absorbing member used in JP-A-5-52166 is rubber in a shape of a rectangular parallelepiped and an area thereof in contact with an inner wall of a containing portion thereof is large. Therefore, compression operability of the shock absorbing member is poor and the shock absorbing member is likely to easily wear.

Further, the shock absorbing member only receives reaction force in the circumferential direction of the internal gear. There is not a specific disclosure with regard to supporting the internal gear in an axial direction. In addition, the internal gear is not provided with a detent and therefore, the internal gear continues rotating little by little while the exerted reaction force is large. As a result, efficiency of transmitting driving force of the motor is likely to be lessened.

SUMMARY OF THE INVENTION

The present invention has been carried out in view of such a situation and it is an object of the present invention to provide a starting apparatus capable of alleviating shock load applied in accordance with a variation in engine load from the start and achieving compact formation.

It is another object of the present invention to provide a starting apparatus capable of resolving unpleasant sound in starting.

It is further another object of the present invention to provide a comparatively simple and efficient starting apparatus with improvements of durability of a shock absorbing member and reliability.

According an aspect of the present invention, a starting apparatus includes a drive motor and a reduction gear. The reduction gear includes a sun gear rotated by receiving an input from the drive motor, an internal gear arranged concentrically around the sun gear, a rotation restricting member for restricting free rotation of the internal gear, a shock absorbing member interposed between the internal gear and the rotation restricting member. A carrier rotatably supports a planetary gear meshing with the sun gear and the internal gear and outputs an input of the sun gear by reducing a speed thereof. A driving force from the drive motor is transmitted to an engine via the reduction gear, thereby starting the engine.

The internal gear includes a locking projection projecting from a side face thereof along a rotation axis of the reduction gear. The locking projection is loosely received in a guide groove formed on the rotation restricting member, and guided therein in a circumferential direction. The shock absorbing member is held in the guide groove in a state of being elastically in close contact with circumferential side faces of the locking projection.

According to the starting apparatus, the locking projection projects in the axial direction from the side face of the internal gear. Therefore, an outer diameter of the reduction gear is not enlarged.

The locking projection can be moved in the guide groove of the rotation restricting member in a certain range in accordance with a direction of reaction force or impact load applied to the internal gear from the planetary gear. In this case, the locking projection is elastically supported by the shock absorbing member in the guide groove from both of the sides in the circumferential direction, irrespective of whether reaction force is applied to the internal gear. Thus, the internal gear is in a state of being elastically held from start of operating reaction force. Even when the reaction force or the shock load is released, also the other side face of the locking projection in the circumferential direction is elastically supported by the shock absorbing member. Therefore, it is less likely that rapid load will be operated to the internal gear.

Accordingly, large shock load to the internal gear is suppressed. Reliability of the starter is ensured even when the internal gear is made of synthetic resin. Further, by alleviating the shock load, unpleasant sound generated in starting the engine is also decreased. Although the shock absorbing member includes a spring or the like, an elastic body comprising rubber or the like is general therefore in consideration of cost, shock absorbing function or the like.

According to another aspect of the present invention, a starting apparatus includes a drive motor and a reduction gear. The drive motor starts to rotate an engine via the reduction gear. The reduction gear includes a sun gear rotated by receiving an input from the drive motor, an internal gear arranged concentrically with the sun gear on an outer peripheral side of the sun gear, a planetary gear meshing with the sun gear and the internal gear, a carrier rotatably supporting the planetary gear and outputting an input of the sun gear by reducing a speed thereof. The reduction gear further includes a rotation constraining unit for constraining rotation of the internal gear arranged movable in a circumferential direction.

The rotation constraining unit includes a movable locking portion integrated movable with the internal gear in the circumferential direction, an unmovable locking portion arranged in a state opposing to the movable locking portion in the circumferential direction and unmovable in the circumferential direction, and a shock absorbing member including an elastic block portion. The elastic block portion is elastically held at least between the movable locking portion and the unmovable locking portion. The elastic block portion elastically receives a reaction force applied to the internal gear when the drive motor starts to rotate the engine via the reduction gear.

According to the starting apparatus, the internal gear is restricted from rotating at least in one direction by the rotation constraining unit including the movable locking portion, the unmovable locking portion and the shock absorbing member.

In starting the engine, the internal gear receives a reaction force in a direction opposite to an output of the carrier. The reaction force is received by the unmovable locking portion from the movable locking portion integrally moved with the internal gear via the elastic block portion of the shock absorbing member. Thus, the internal gear is restricted from rotating in the direction of the reaction force.

The reaction force is gradually elastically received by the unmovable locking portion. Therefore, it is less likely that shock load will be applied to respective portions and unpleasant sound will be caused by direct contact of locking members. Further, the shock absorbing member also works as a vibration isolating member and therefore, can absorb vibration and sound generated at the reduction gear or a surrounding thereof. In this way, the reduction gear can reduce vibration, unpleasant sound generated in operating the starting apparatus although the reduction gear is provided with a comparatively simple structure.

BRIEF DESCRIPTION OF THE DRAWINGS

Other objects, features and advantages of the present invention will become more apparent from the following detailed description made with reference to the accompanying drawings, in which like parts are designated by like reference numbers and in which:

FIGS. 13A and 13B are planarly developing views showing operation of the cylindrical resin member, the shock absorbing member and the containing case, in which FIG. 13A shows a state before operation of the starting apparatus and FIG. 13B shows a state during the operation of the starting apparatus.

DETAILED DESCRIPTION OF EMBODIMENTS

Figure 2:
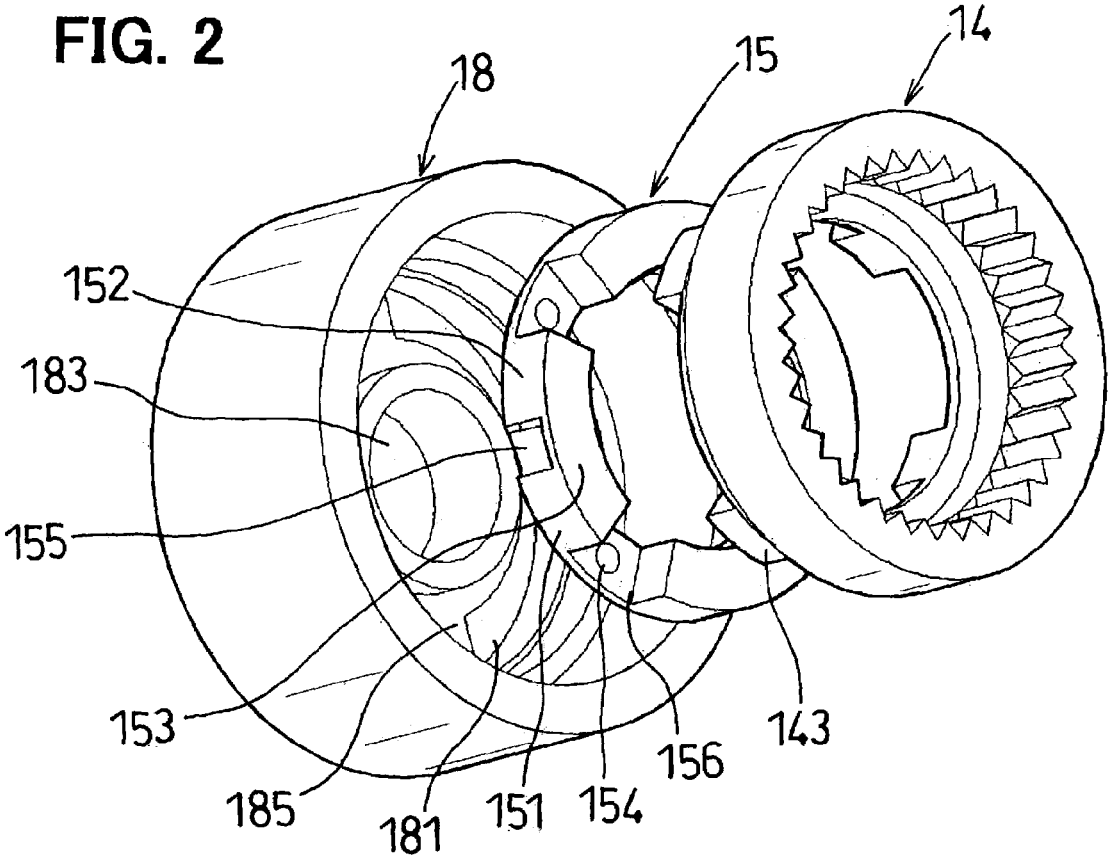
FIG. 2 is an exploded perspective view of an essential portion of a reduction gear of the starting apparatus according to the first embodiment of the present invention.
Figure 3:
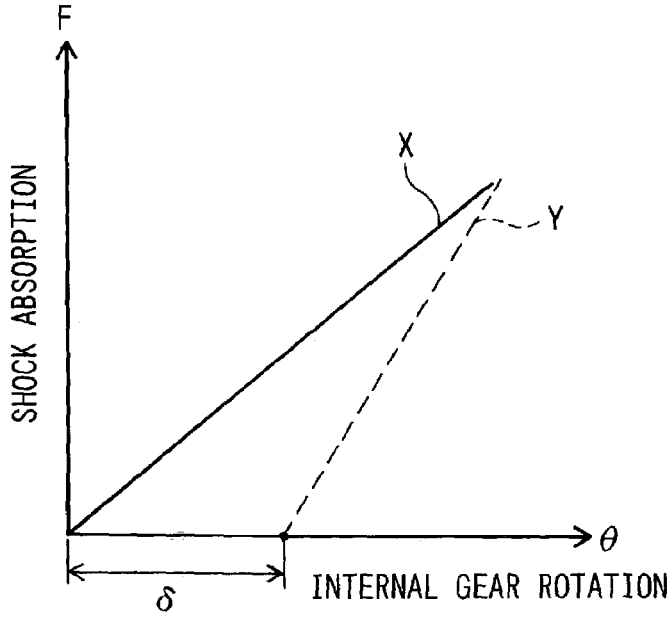
FIG. 3 is a graph showing a relationship between a rotational displacement of an internal gear in the reduction gear and shock absorbing function by a shock absorbing member according to the first embodiment of the present invention.

The first embodiment of the present invention will be described hereinafter with reference to FIGS. 1 through 3.

Figure 1:
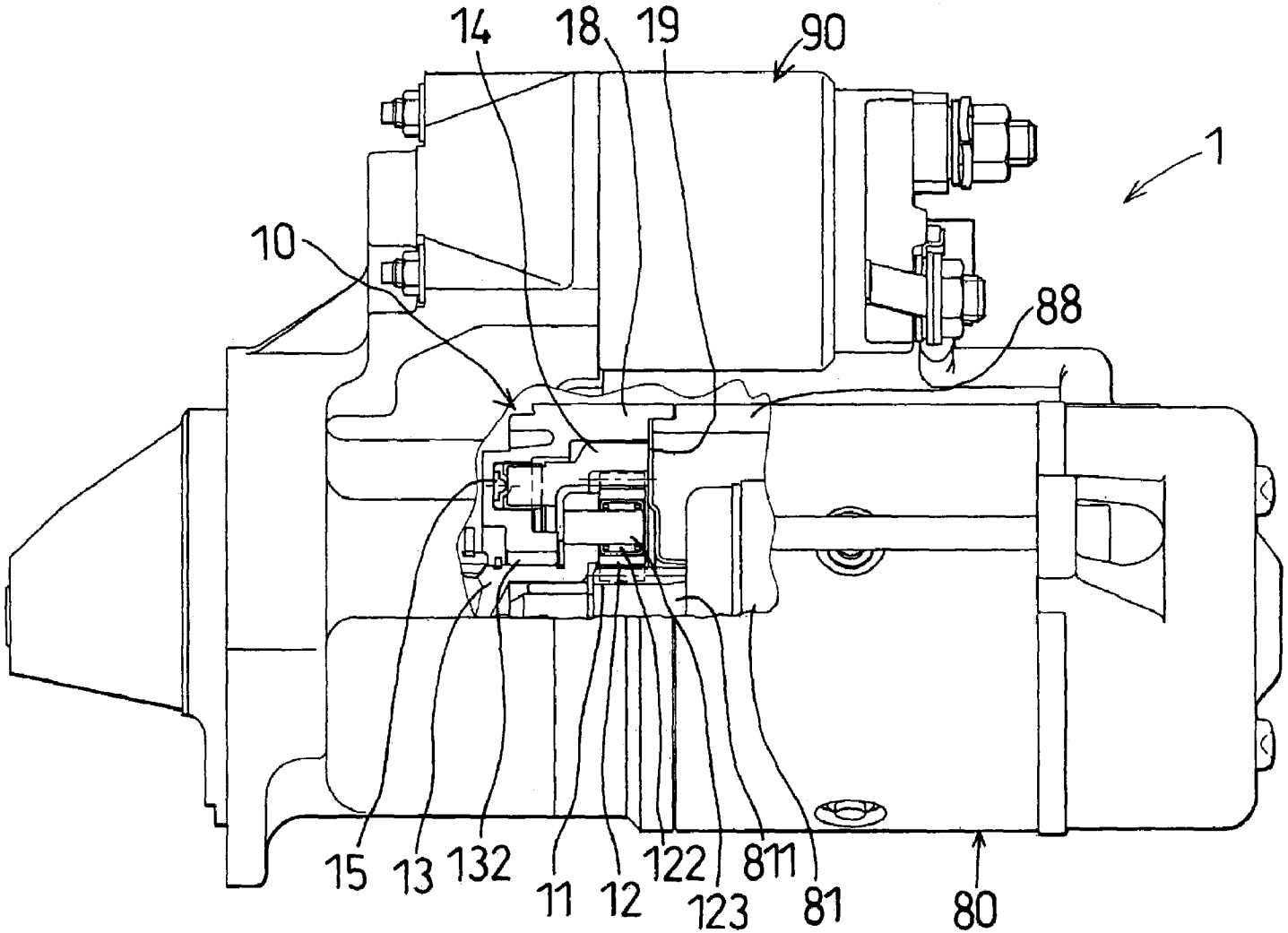
FIG. 1 is a general view of a starting apparatus according to the first embodiment of the present invention.

FIG. 1 shows a gear-type starter (hereinafter, simply referred to as a starter) 1. The starter 1 mainly includes a reduction gear 10, a motor 80 and a magnet switch 90. Although not illustrated in details, an output of the motor 80 is transmitted to an output shaft that is formed with a helical spline on its outer peripheral face via the reduction gear 10.

An overrunning clutch (one way clutch) and a pinion gear are arranged on the helical spline. (See, FIG. 7) In starting, the overrunning clutch and the pinion gear are pushed in an axially forward direction (to a left side of FIG. 1) by lever operation of the magnet switch 90. Further, the pinion gear is temporarily brought in mesh with a ring gear attached to a crankshaft of the engine to thereby crank the engine. When the engine has been started, the pinion gear of the starter 1 is idly rotated by the overrunning clutch to thereby prevent excessive rotation of the motor 80.

The reduction gear 10 has a sun gear 11, three planetary gears 12, a carrier 13, an internal gear 14, a shock absorbing member 15, and a gear housing (rotation restricting member) 18. The sun gear 11 is formed on or spline-fitted to a motor main shaft 811 that extends from a rotor 81 of the motor 80. The three planetary gears 12 are arranged at a surrounding of the sun gear 11. The planetary gears 12 mesh with the sun gear 11. The carrier 13 rotatably and revolvably supports the planetary gears 12 via a roller bearing 122 and a pin 123. The internal gear 14 is arranged on outer peripheral sides of the planetary gears 12. The internal gear 14 has internal teeth and meshes with the planetary gears 12. The gear housing 18 covers the outer periphery and an axially front end (left side of FIG. 1) of the internal gear 14. The shock absorbing member 15 is interposed between the internal gear 14 and the gear housing 18.

The gear housing 18 is fixed to a motor housing 88 that surrounds the motor 80 at an axially front end of the motor housing 88. A cover plate 19 is provided between the gear housing 18 and the motor housing 88 to partition therebetween. The cover plate 19 is in contact with a rear end face of the internal gear 14 to thereby also restrict the internal gear 14 in the axial direction. Further, the internal gear 14 is made of thermosetting resin.

Next, an explanation will be given of the internal gear 14, the shock absorbing member 15 and the gear housing 18 which are characteristic portions of the embodiment with reference to FIG. 2.

The internal gear 14 has four locking projections 143. The locking projections 143 projects from an axial front surface of the internal gear 14 at a slightly inner peripheral side. The locking projections 143 are arranged at equal intervals in a circumferential direction of the internal gear 14. Inner and outer peripheral faces of the locking projection 143 include circular arc faces. Circumferential faces of the locking projection 143 lie substantially perpendicular to the circumference of the gear.

The shock absorbing member 15 is a ring-shaped rubber member. The shock absorbing member 15 includes locking recessed portions 156 at an axial rear end face and fixed recessed portions 155 at an axial front end face. Rubber blocks (elastic blocks) disposed on both sides of the locking recessed portion 156 constitute a first elastic block portion 151 and a second elastic block portion 152. A portion connecting the first elastic block portion 151 and the second elastic block portion 152 on a side opposite to the fixed recessed portion 155 constitutes a bridging portion 153. Further, a small semispherical elastic projection 154 protrudes from a center of a bottom face of the locking recessed portion 156 in an axially rear direction. Further, the shock absorbing member 15 is made of oil resistant rubber (for example, NBR) that is not easily deteriorated even when grease or the like is adhered thereto. The shock absorbing member 15 is formed by integral molding of rubber.

The gear housing 18 is a substantially cylindrical member and provided with a through hole 183 to support an output shaft of the carrier 13 via a sleeve bearing 132 (FIG. 1) at a center thereof. Guide grooves 181 having bottomed circular arc shapes are arranged in a ring-like shape at equal intervals in the circumferential direction to surround an outer periphery of the through hole 183. Further, the guide grooves 181 are partitioned with ribs 185 extending in a radial direction.

The respective members are integrated as follows. First, the shock absorbing member 15 is press-fitted to the guide grooves 181 of the gear housing 18. At this time, the first elastic block portion 151 and the second elastic block portion 152 opposing each other by interposing the locking recessed portion 156 are fitted in the same guide groove 181.

Further, the fixed recessed portion 155 is fitted to the rib 185 of the gear housing 18. In this condition, there is no clearance or play between the gear housing 18 and the shock absorbing member 15 in the circumferential direction. Further, the locking projection 143 of the internal gear 14 is press-fitted to the locking recessed portion 156 of the shock absorbing member 15.

Therefore, circumferential faces of the first elastic block portion 151 and the second elastic block portion 152 that are opposed through the locking recessed portion 156 are in a state of being elastically in close contact with the circumferential faces of the locking projection 143. That is, the locking projection 143 is in a state of being previously pressed by the first elastic block portion 151 and the second elastic block portion 152.

Accordingly, the shock absorbing member 15 absorbs shock load applied to the internal gear 14 gradually from start of displacement thereof in the circumferential direction. The behavior is shown in FIG. 3 by a solid line X. FIG. 3 conceptually shows a relationship between rotational displacement of the internal gear and shock absorbing function of the shock absorbing member. A dotted line Y shows a case in which a shock absorbing member is not in close contact with the locking projection and a clearance (δ) is present between the shock absorbing member and a wall face of a guide groove as in the prior art. In the case of the dotted line Y, shock load is absorbed after an internal gear is displaced by an amount of the clearance. Further, the absorption is considerably rapid by an amount of retarding to absorb shock load. Therefore, it is known that according to the conventional shock absorbing structure, absorption and reduction of the shock load applied to the internal gear are insufficient.

According to the embodiment, the locking projection 143 extending from the front face of the internal gear 14 in the axial direction and therefore, the reduction gear 10 is not enlarged in the outer diameter direction.

Also, the locking projections 143 can move in the guide grooves 181 of the rotation restricting member 18 in a certain range in accordance with a direction of reaction force or impact load applied to the internal gear 14 from the planetary gears 12. The locking projections 143 are elastically supported at the circumferential faces by the shock absorbing member 15, which is held in the guide grooves 181, in the circumferential direction, irrespective of whether reaction force is applied to the internal gear 14. That is, the internal gear 14 is elastically held from start of operating reaction force.

Further, even when the reaction force or the shock load is released, the circumferential faces of the locking projections 143 are elastically supported by the shock absorbing member 15. Therefore, it is less likely that the load will be rapidly applied to the internal gear 14. In this way, the internal gear 14 is restrained from large shock load more than that of the prior art. The internal gear 14 is firmly protected. As a result, reliability of the starter 1 is ensured even when the internal gear 14 is made of synthetic resin. Further, by the alleviation of the shock load, unpleasant sound generated in starting the engine is decreased.

Meanwhile, although the shock absorbing member 15 includes a spring or the like, an elastic body including rubber or the like is general therefore in consideration of cost, shock absorbing function or the like.

Although an explanation has been given of shock absorbing operation when force is applied to the internal gear 14 in the circumferential direction, in consideration of various vibrations applied to the internal gear 14, integration tolerance and the like, it is preferable that the internal gear 14 is elastically held also in the axial direction. Here, the shock absorbing member 15 has the semispherical elastic projections 154 projecting in the axial direction. Therefore, the axial end faces of the locking projections 143 are elastically held by the elastic projections 154.

Figure 4:
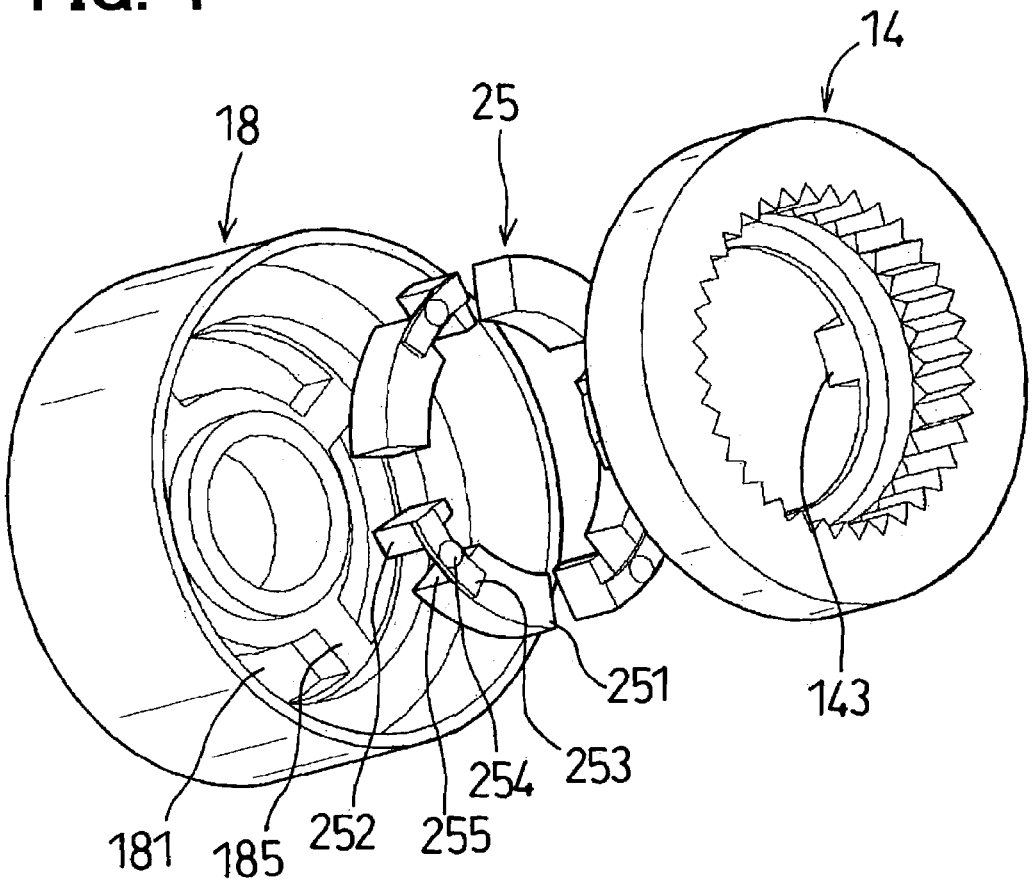
FIG. 4 is an exploded perspective view of an essential portion of the reduction gear according to the second embodiment of the present invention.

Next, the second embodiment will be described with reference to FIG. 4.

In the second embodiment, a shock absorbing member 25 has a shape different from the shape of the shock absorbing member 15 of the first embodiment. Shock load applied to the internal gear 14 is absorbed by four independent shock absorbing members 25 each having the same shape.

Each of the shock absorbing member 25 includes a first elastic block portion 251, a second elastic block portion 252 and a bridging portion 253 for bridging the first elastic portion 251 and the second elastic portion 252. An elastic projection 254 is formed on the bridging portion 253 to elastically contact with an axially front end face of the internal gear 14. The shock absorbing member 25 is formed by integral molding of rubber.

The shock absorbing member 25 is fixed to the gear housing 18 such that a fixed recessed portion 255 formed between the first elastic block portion 251 and the second elastic block portion 252, that is, on a front side of the bridging portion 253 is press-fitted to the rib 185 partitioning the guide grooves 181. Therefore, the first elastic block portion 251 and the second elastic block portion 252 of one of the block absorbing members 25 are respectively held in contiguous ones of the guide grooves 181. Further, the locking projection 143 of the internal gear 14 is press-fitted between the first elastic block portion 251 of one shock absorbing member 25 and the second elastic block portion 252 of the different shock absorbing member 25.

Reaction force or shock load applied to the internal gear 14 is received and absorbed mainly by the first elastic block portion 251 having a larger rubber volume. At this time, a circumferential face of the first elastic block portion 251 on a side of the bridging portion 253 is supported by the rib 185, that is, supported by an inner wall of the guide groove 181.

Therefore, even when the first elastic block portion 251 is considerably contracted, the bridging portion 253 is hardly effected by that contraction. That is, different from the case of the shock absorbing member 15, the bridging portion 253 is not stretched by the contraction of the first elastic block portion 251. Accordingly, the elastic projection 254 stably, presses the front end face of the internal gear 14 in the axial direction.

In the second embodiment, the first and the second elastic block portions 251, 252 are filled in the guide grooves 181. Therefore, the locking projections 143 are held in a state of being elastically in contact with the shock absorbing member 25.

In a case that there are a plurality of partitioned guide grooves, a large number of steps are required for fitting the elastic members piece by piece. Also, a number of parts is increased. However, the plurality of guide grooves 181 is arranged at equal intervals in the circumferential direction. Also, the shock absorbing member 25 is formed such that the first elastic block portion 251 and the second elastic block portion 252, which are respectively fitted in contiguous guide grooves 181, are connected by the bridging portion 253 to span the one guide groove 181. Accordingly, the number of parts is reduced. Further, the first elastic block portion 251 and the second elastic block portion 252 can be fitted in the guide grooves 181 in one motion.

Further, the elastic projection 254 is provided at the bridging portion 253 to elastically contact with the front end face of the internal gear 14. Since the shock absorbing members 25 are separate in the circumferential direction, influence by the contraction of the first elastic block portion 251 or the second elastic block portion 252 is hardly effected on the bridging portion 253 due to restriction by the inner wall of the guide groove 181. That is, the elastic projection 254 is not moved in the circumferential direction by being dragged by contraction of the elastic block portions 251, 252. Thus, the elastic projection 254 can stably urge the internal gear 14 in the axial direction. Accordingly, uneven wear or the like of the internal gear 14 can be effectively restrained. Thus, reliability of the starter 1 increases.

Next, the third embodiment will be described with reference to FIG. 5. In the third embodiment, the shock absorbing member 35 includes a first elastic block portion 351, a second elastic block portion 352 and a bridging portion 353, similar to the shock absorbing member 25 of the second embodiment. However, the first elastic block portion 351 is significantly different from the first elastic block portion 251 of the shock absorbing member 25 in that a central portion of the first elastic block portion 351 is slenderly constricted. That is, the first elastic block portion 351 includes end portions 351*a* and 351*b* and a constricted portion 351*c*.

The end portions 351*a* is a portion being in contact with the circumferential face of the locking projection 143 of the internal gear 14. Further, the end portions 351*a* and 351*b* are fitted in the guide groove 181 in a state that the inner and outer peripheral walls of the end portions 351*a*, 351*b* are loosely in contact with inner walls of the guide groove 181.

That is, the end portions 351*a*, 351*b* are held in the guide groove 181 in a loosely press-fitted state. Meanwhile, the constricted portion 351*c* is not in contact with either of inner walls of the guide groove 181 and an air gap is formed therebetween.

Further, when reaction force or impact load is operated to the internal gear 14 and the first elastic block portion 351 is pressed, the constricted portion 351*c* that has small deformation resistance (low rigidity) mainly starts contracting and expanding in the outer peripheral direction. At this time, since the air gap is present between the constricted portion 351*c* and the inner wall of the guide groove 181, considerable deformation function is manifested by the constricted portion 351*c*. Thus, the shock absorbing member 35 provided shock absorbing function larger than that of the shock absorbing member 25.

Figure 5:
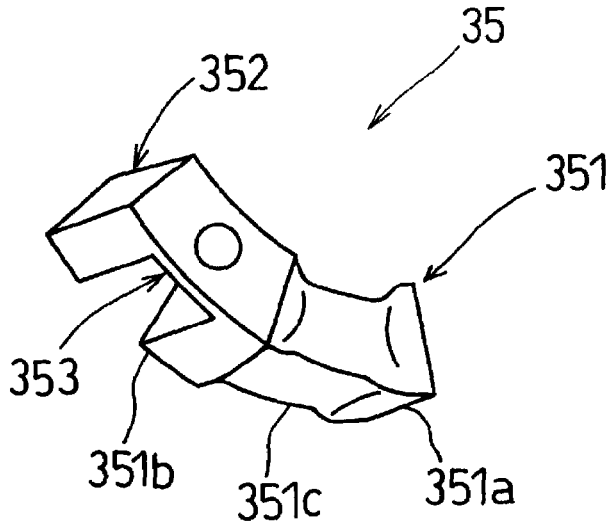
FIG. 5 is an enlarged perspective view of a shock absorbing member according to the third embodiment of the present invention.

Further, FIG. 5 shows a case in which width of the bridging portion 353 is expanded in the radial direction more than the bridging portion 253 of the shock absorbing member 25.

When the guide groove 181 is excessively filled with the elastic block, deformation resistance of the elastic block portion 351 is rapidly increased and block absorbing function by the elastic block portion 251 is reduced. Hence, in order to ensure the deformation resistance of the elastic block portion 351 in a certain range, a volume of the elastic block portion 351 is increased when deformed may be devised to escape.

In the third embodiment, the central portion 351*c* of the first elastic block portion 351 is narrower than the end portions 351*a*, 351*b*. Thus, the first elastic block portion 351 is contractable in the circumferential direction. Further, the clearance is formed between the first elastic block portion 351 and the walls of the guide groove 181. Therefore, the first elastic block portion 351 can be stably deformed by an amount of the clearance.

Further, the end portions 351*a*, 351*b* of the first elastic block portion 351, which are elastically in contact with the end face of the locking projection 143, are conversely thickened and therefore, the first elastic block portion 351 can firmly receive reaction force or shock load applied to the internal gear 14. It is preferable that the circumferential end face of the end portion 351*a* and the circumferential end face of the locking projection 143 which are in contact with each other, have the same size.

Next, the fourth embodiment will be described with reference to FIG. 5. By devising the shape of the first elastic block portion 351, the deformation resistance is restrained to be low to provide the shock absorbing member 35 excellent in shock absorbing function. However, there is a limit therein, for example, when shock load larger than anticipated is abruptly operated, the first elastic block portion 351 is expanded in an outer diameter direction in accordance with contraction in the circumferential direction and also the outer peripheral face of the constricted portion 351*c* is brought into close contact with the inner wall of the guide groove 181. Then, abruptly, the deformation resistance of the first elastic block portion 351 increases. As a result, shock absorbing performance by the shock absorbing member 35 decreases.

Figure 6:
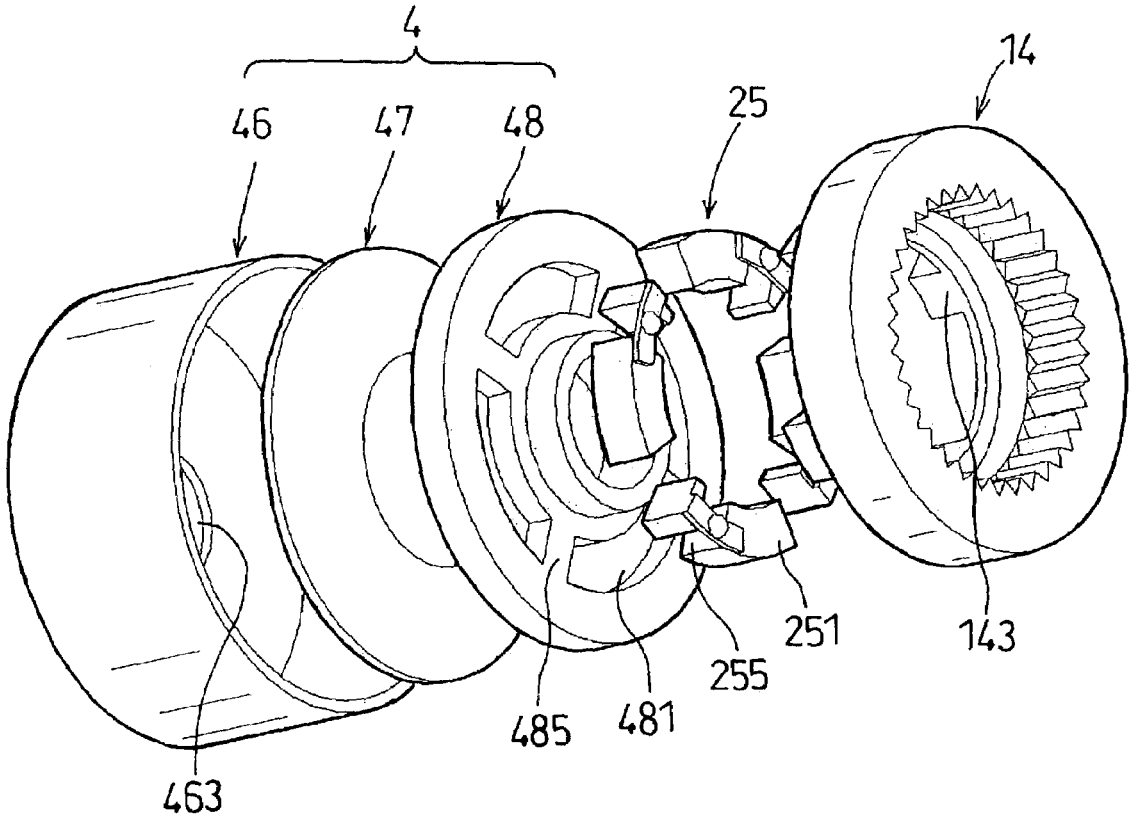
FIG. 6 is an exploded perspective view of an essential portion of the reduction gear according to the fourth embodiment of the present invention.

Hence, in order to ensure the shock absorbing function by the shock absorbing member even when shock load or the like larger than anticipated is applied, it is preferable to make a volume of the guide groove 181 variable. FIG. 6 shows such a structure.

In the fourth embodiment, the internal gear 14 and the shock absorbing member 25 are similar to those of the second embodiment. Although the shock absorbing member 25 is illustrated in FIG. 6, the shock absorbing member 15 may be used in place thereof, further, when the shock absorbing member 35 is used, more excellent shock absorbing function is achieved.

The fourth embodiment is characterized in a structure of a gear housing 4. The gear housing 4 includes a circular disc 48, a Belleville spring 47, and a case 46. The circular disk 48 is formed with guide grooves 481 penetrated in a circular arc shape uniformly at four locations. The belleville spring 47 is arranged on an axially front side of the circular disk 48. The case 46 has a bottomed cylindrical shape. The case 46 surrounds the circular disk 48 and the belleville spring 47 and has a through hole 463 at a center thereof.

When the respective members are arranged as shown by FIG. 6 and integrated, the belleville spring 47 forms a bottom portion of the guide grooves 481. When load is applied in the axial direction, the belleville spring 47 is flexed in a direction of the load to expand a volume of the guide groove 481.

Specifically, when the first elastic block portion 251 of the shock absorbing member 25 is pressed by the locking projection 143 of the internal gear 14 to contract in the circumferential direction, the first elastic block portion 251 is expanded to an outer side, thereby pressing the belleville spring 47.

When the pressing force exceeds predetermined load, the belleville spring 47 is flexed and the volume of the guide groove 481 is expanded. As a result, the first elastic block portion 251 contracted in the circumferential direction is produced with an allowance of further expanding to the other side.

In this way, stable shock absorbing function by the shock absorbing member 25 is ensured without rapidly increasing the deformation resistance of the first elastic block portion 251. Further, a clearance for bending the belleville spring 47 is naturally ensured between the belleville spring 47 and a bottom portion of the case 46. A wave washer or the like may substitute for the belleville spring 47. Further, although not illustrated in the drawings, a stopper is provided between an outer peripheral side of the internal gear 14 and the gear housing 4, 18. Thereby, an allowed revolution amount of the internal gear 10 is finally restricted.

In this way, the volume of the guide grooves 481 can be changed in accordance with contraction of the first elastic block portion 251 without devising the shape of the first elastic block portion 251. Naturally, the volume of the guide grooves 481 can be changed also by making an inner wall thereof movable other than the bottom portion. However, in order to change the volume of the guide groove 481 without increasing an outer diameter of the reduction gear, a request for compact formation of the starter is complied with, further, the change of the volume of the guide groove 481 can be realized by a comparatively simple mechanism by making the bottom portion movable in the axial direction.

Accordingly, not only the starting apparatus 1 is compact but also shock load or the like applied to the internal gear 14 of the reduction gear 10 is more firmly absorbed and reliability of the internal gear 14 and therefore, the starting apparatus 1 can be promoted.

Next, the fifth embodiment will be described with reference to FIGS. 7 through 13B.

Figure 7:
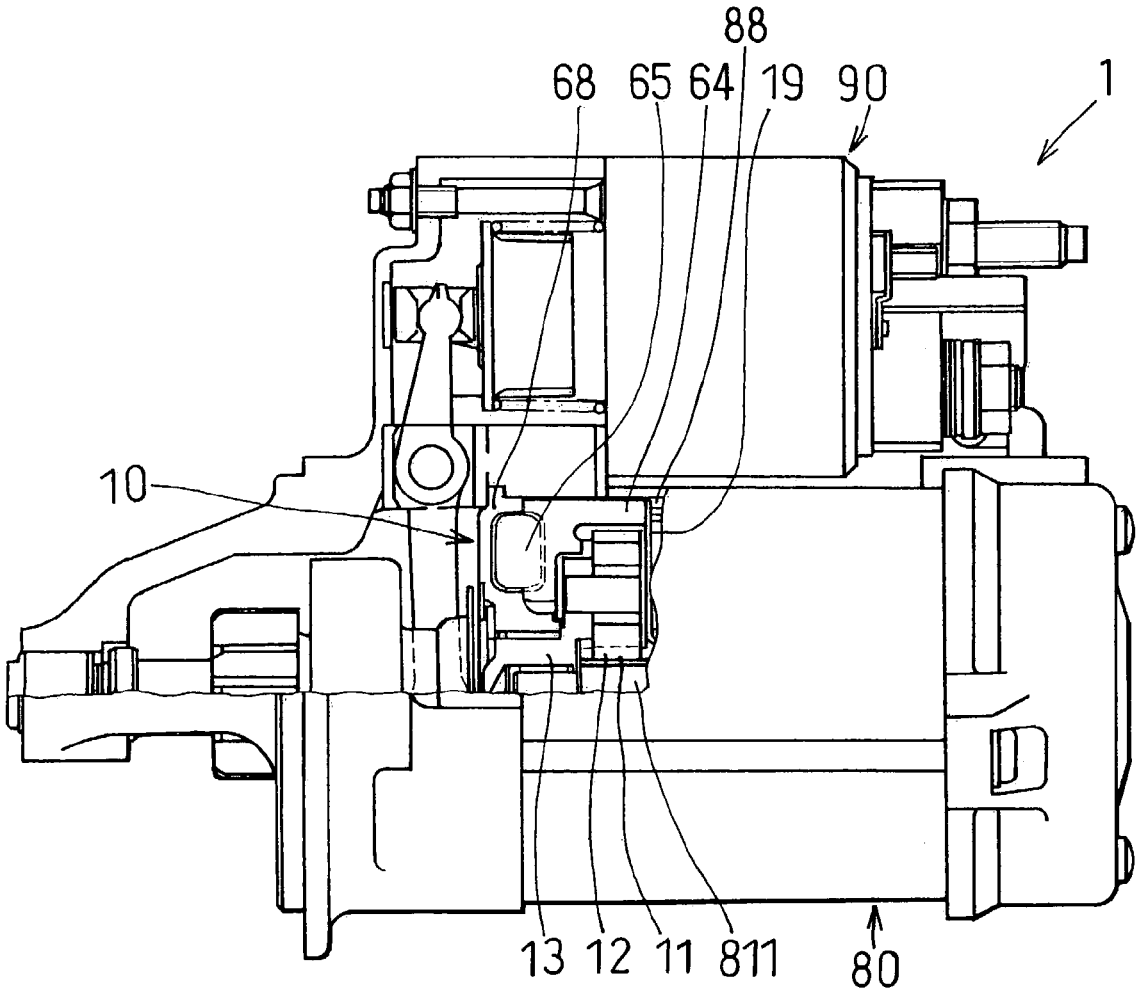
FIG. 7 is a general view of a starting apparatus showing an essential portion according to the fifth embodiment of the present invention.

As shown in FIG. 7, the internal gear 649 is formed on an inner cylindrical wall of a cylindrical resin member 64. The cylindrical resin member 64 meshes with the planetary gears 12 through the internal gear 649. A containing case 68 (case) is provided on the front side (left side of FIG. 7) of the cylindrical resin member 64, in place of the gear housing 4, 18. A shock absorbing member 65 is interposed between the cylindrical resin member 64 and the containing case 68.

The cover plate 19 is provided at a rear end face of the cylindrical resin member 64, similar to the first embodiment. Thus, the cover plates 19 closes a front portion of the motor housing 88 of the motor 80 and restricting the cylindrical resin member 64 from moving backward in the axial direction.

The cylindrical resin member 64, the shock absorbing member 65 and the containing case 68 are included in a rotation constraining unit which is characterizing portion of the fifth embodiment.

Figure 8:
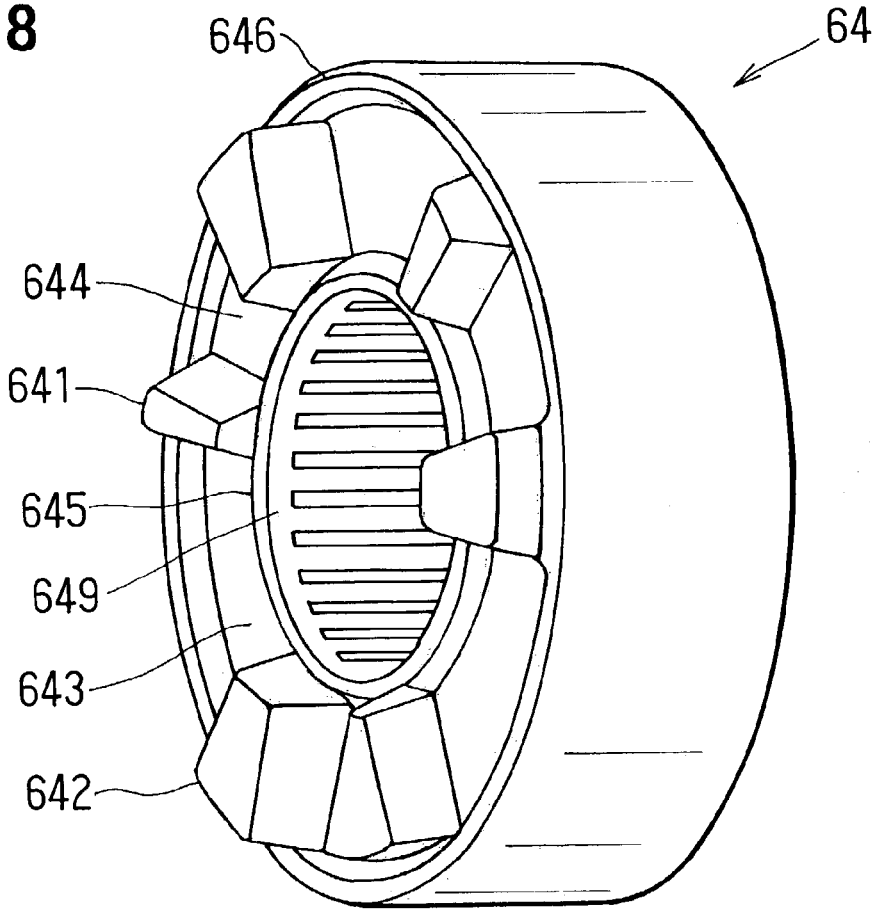
FIG. 8 is an enlarged perspective view of a cylindrical resin member of a reduction gear according to the fifth embodiment of the present invention.

As shown in FIG. 8, the cylindrical resin member 64 has substantially a cylindrical shape having a ring-shaped bottom face. The cylindrical resin member 64 is integrally molded by thermoplastic resin. Also the internal gear 649 is integrally molded on the inner cylindrical wall of the cylindrical portion disposed on the rear side (right side of FIG. 8) of the cylindrical resin member 64.

The ring shape bottom face of the cylindrical resin member 64 is disposed on a front side of the cylindrical resin member 64. The bottom face is provided with three pairs of movable locking projections 641 and movable contact projections 642 projecting in the axially forward direction. The movable locking projections 641 and the movable contact projections 642 are radially and uniformly arranged. A wall thickness of the movable contact projection 642 is thicker than a wall thickness of the movable locking projection 641 to be able to stably receive large reaction force.

Further, the cylindrical resin member 64 is provided with an inner ring-like projection 645 and an outer ring-like projection 646 projecting slightly to the front side from an inner peripheral edge and an outer peripheral edge of the bottom face. Further, main movable recessed portions 643 and sub movable recessed portions 644, which are slightly recessed, are alternately formed by the inner ring-like projection 645, the outer ring-like projection 646, the movable locking projections 641, and the movable contact projections 642.

Further, a ratio of lengths in the circumferential direction of the main movable recessed portion 643 and the sub movable recessed portion 644 can be easily adjusted at where the movable locking projection 641 is arranged between the contiguous movable contact projections 642.

Figure 9:
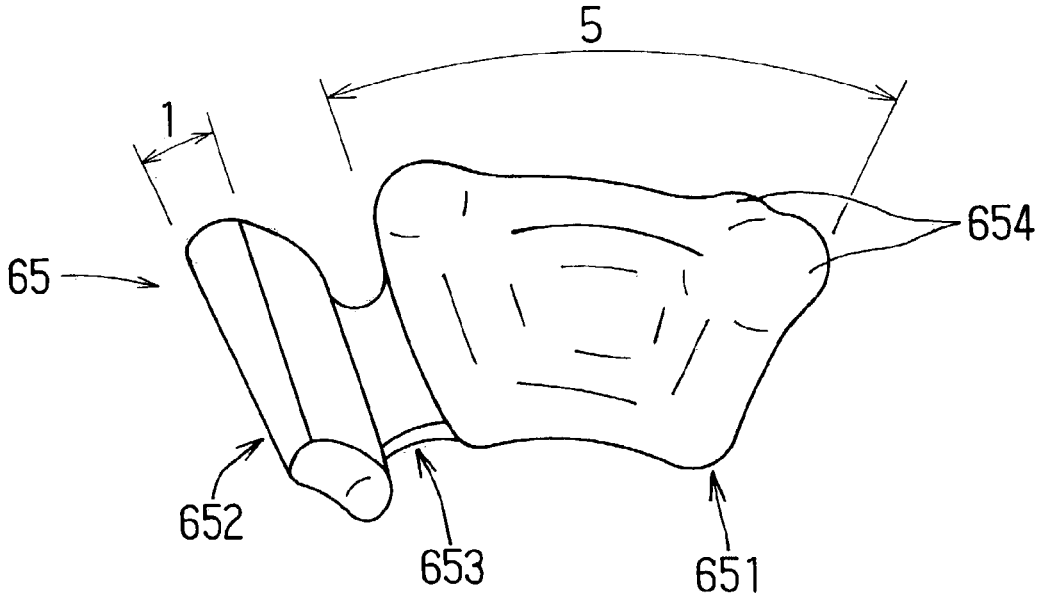
FIG. 9 is an enlarged perspective view of a shock absorbing member of the reduction gear according to the fifth embodiment of the present invention.

As shown in FIG. 9, the shock absorbing member 65 includes a main elastic block portion 651, a sub elastic block portion 652 and a bridging portion 653 bridging the main elastic block portion 651 and the sub elastic block portion 652. The shock absorbing member 65 is integrally molded by an oil resistant synthetic resin (NBR or the like). Here, the oil resistant synthetic resin is used such that the rubber is not deteriorated even when grease used for reducing abrasive resistance is adhered to the rubber, the function of the shock absorbing member 65 is maintained for a long period of time.

The main elastic block portion 651 is in the form of a fan-shaped block and a surrounding of substantially a central portion thereof is constricted, that is, is narrow. Further, semispherical elastic projections 654 are provided at an outer peripheral end of the main elastic block portion 651 on both axial front and rear faces to make contact with the containing case 68.

Although the sub elastic block portion 652 is in the form of a fan-shaped block, its circumferential length is considerably shorter than that of the main elastic block portion 651. In this embodiment, the ratio of circumferential lengths of the main elastic block portion 651 and the sub elastic block portion 652 is set to about 5:1. The bridging portion 653 connects ends of the main elastic block portion 651 and the sub elastic block portion 652 in a strip-like shape.

Figure 10:
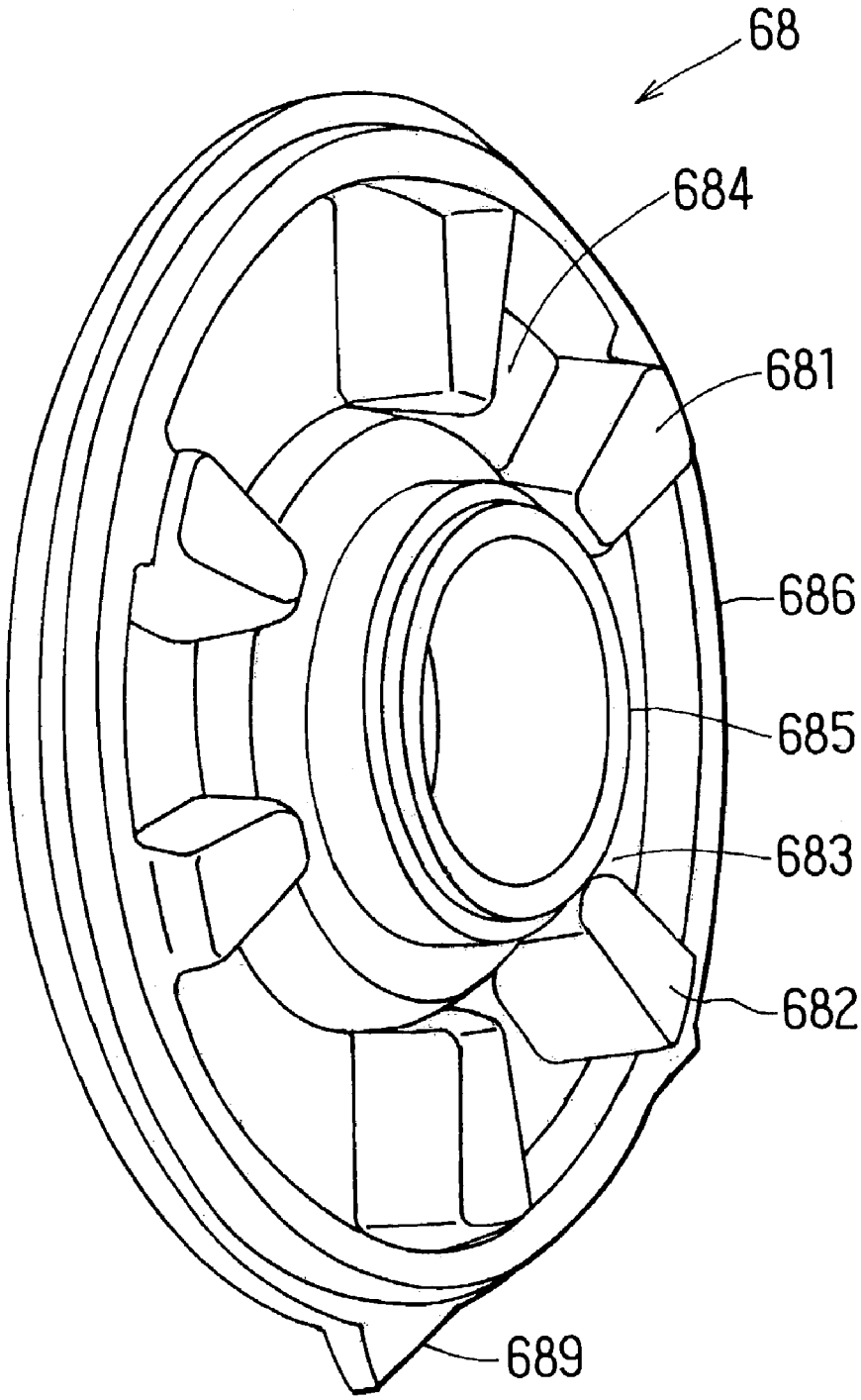
FIG. 10 is an enlarged perspective view of a containing case of the reduction gear according to the fifth embodiment of the present invention.

As shown in FIG. 10, the containing case 68 has substantially a circular disk shape. The containing case 68 is formed by pertinently machining an aluminum alloy cast product. Although a front side (left side of FIG. 10) of the containing case 68 is formed substantially in a shape of a planar plate, a rear side (right side) thereof is provided with three pairs of unmovable locking projections 681 and unmovable contact projections 682 projected to a rear side in the axial direction. The unmovable locking projections 681 and unmovable contact projections 682 are radially and uniformly arranged. A wall thickness of the unmovable contact projection 682 is thicker than a wall thickness of the unmovable locking projection 681 to be able to stably receive large reaction force.

Further, the containing case 68 is provided with an inner ring-like projection 685 and an outer ring-like projection 686 projecting to the rear side from an inner peripheral side and an outer peripheral side on the rear side of the containing case 68. Further, main unmovable recessed portions 683 and sub unmovable recessed portions 684, which are recessed, are alternately formed by the inner ring-like projection 685, the outer ring-like projection 686, the unmovable locking projections 681, and the unmovable contact projections 682.

Further, a ratio of circumferential lengths of the main unmovable recessed portion 683 and the sub unmovable recessed portion 684 can be easily adjusted by to which portion the unmovable locking projection 681 is arranged between the contiguous unmovable contact projections 682.

The containing case 68 is provided with a locking piece 689 on an outer peripheral edge thereof. Although not illustrated, the locking piece 689 is engaged with a housing of the starter 1 to constrain such that the containing case 68 is not rotated in the circumferential direction.

Figure 11:
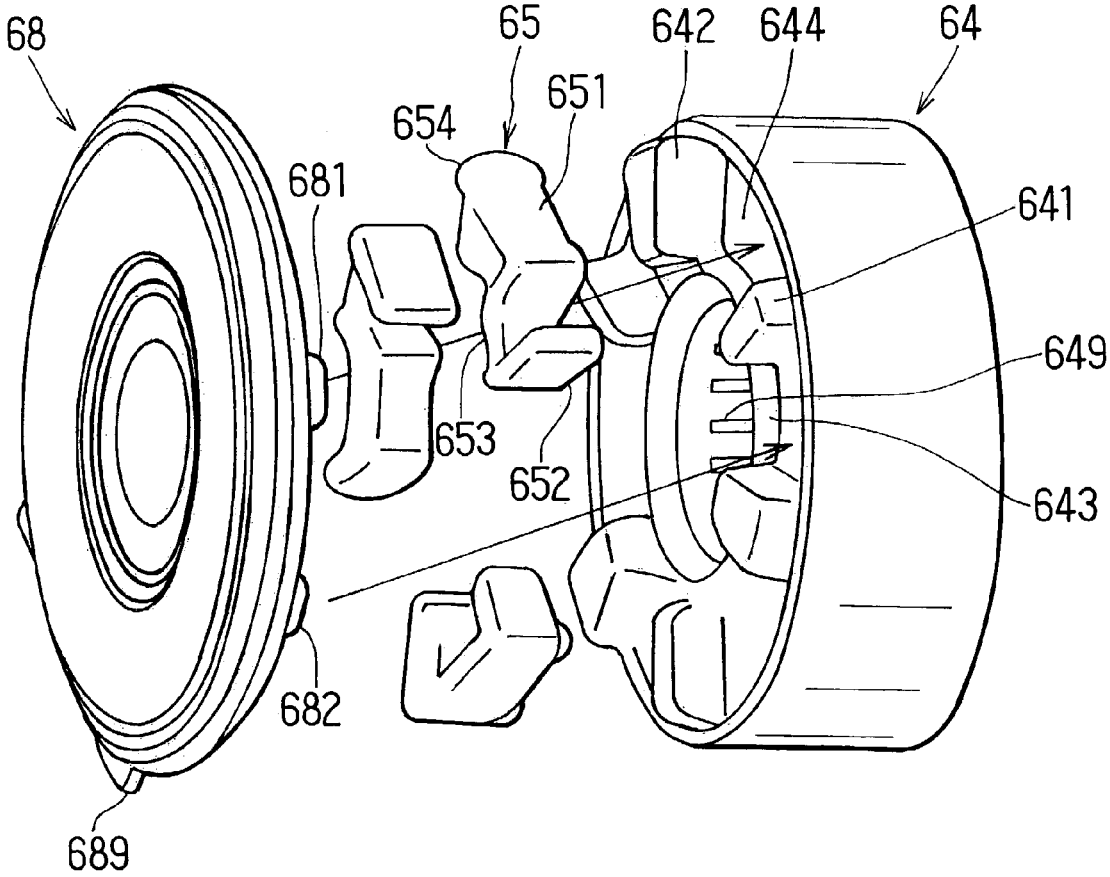
FIG. 11 is an exploded perspective view for explaining arrangement of the cylindrical resin member, the shock absorbing member and the containing case, according to the fifth embodiment of the present invention.

Next, an explanation will be given of integration of the cylindrical resin member 64, the shock absorbing member 65 and the containing case 68 with reference to FIGS. 11 and 12. FIG. 11 shows a disassembled arrangement view of the three members and FIG. 12 shows a state of integrating the shock absorbing member 65 to the cylindrical resin member 64.

Figure 12:
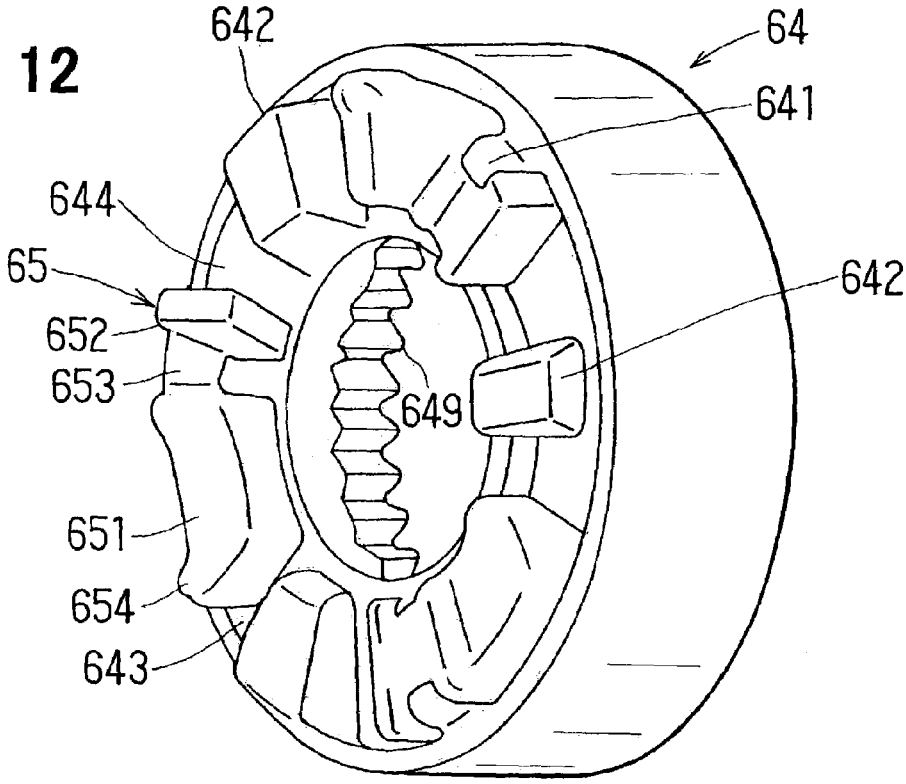
FIG. 12 is a perspective view for explaining arrangement of the shock absorbing member and the cylindrical resin member, according to the fifth embodiment of the present invention.

Although FIG. 12 shows the state of integrating the shock absorbing member 65 to the cylindrical resin member 64 for convenience of explanation, actually, after integrating the shock absorbing member 65 to the containing case 68, the cylindrical resin member 64 is integrated thereto. An explanation will be given as follows in view thereof.

First, the shock absorbing member 65 is integrated to the containing case 68. At this time, the shock absorbing member 65 is integrated to the containing case 68 such that the shock absorbing member 65 is fitted between the unmovable locking projection 681 and the unmovable contact projection 682 of the containing case 68.

Further, the shock absorbing member 65 is integrated to the cylindrical resin member 64 such that the movable locking projection 641 formed at the cylindrical resin member 64 is pushed in between the main elastic block portion 651 and the sub elastic block portion 652 of the shock absorbing member 65.

Thereby, the main elastic block portion 651 and the sub elastic block portion 652 are in a state of elastically holding the movable locking projection 641 therebetween. This integration of the shock absorbing member 65 and the cylindrical resin member 64 is performed at three locations along the circumferential direction.

Thus, the unmovable locking projection 681 is in a state of being substantially interposed between the movable contact projection 642 of the cylindrical resin member 64 and the main elastic block portion 651 of the shock absorbing member 65. Meanwhile, the unmovable contact projection 682 is in a state of elastically interposing the sub elastic block portion 652 of the shock absorbing member 65 between the unmovable contact projection 682 and the movable locking projection 641 of the cylindrical resin member 64.

Further, the inner ring-like projection 645 and the outer ring-like projection 646 of the cylindrical resin member 64 and the inner ring-like projection 685 and the outer ring-like projection 686 of the containing case 68 are formed to respectively correspond to each other. A substantially hermetically sealed inner space is formed between the cylindrical resin member 64 and the containing case 68. Three shock absorbing members 65 are contained in the inner space.

In this condition, the cylindrical resin member 64 is in a state of being elastically supported in the axial direction (thrust direction) relative to the containing case 68 by the elastic projections 654 provided on both face sides of the end portions of the main elastic block portions 651 of the shock absorbing member 65. The elastic projection 654 has the semispherical shape and makes point contact with the wall face.

Therefore, pivoting of the cylindrical resin member 64 relative to the containing case 68 is hardly hampered, and wear or deterioration of the elastic projection 654 is inconsiderable. Further, since the cylindrical resin member 64 is supported by the shock absorbing members 65 at the three locations uniformly disposed in the circumferential direction, the cylindrical resin member 64 is maintained stably. Therefore, transmission loss of the driving force of the internal gear 649 caused by an inclination or the like thereof, wear or the like thereof can be sufficiently restrained and reduced.

Figure 13A:
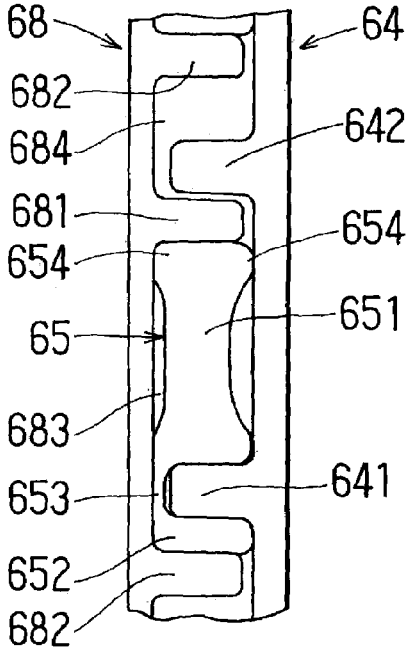
Figure 13B:
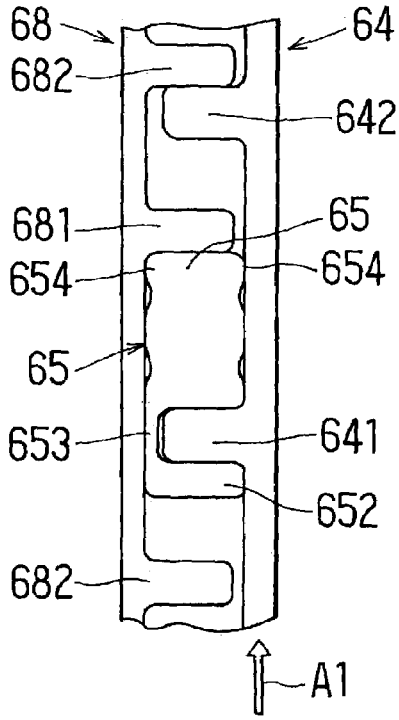

Next, operation of the cylindrical resin member 64, the shock absorbing member 65 and the containing case 68 before and after starting the engine by the starter 1 will be described with reference to FIGS. 13A and 13B. FIGS. 13A and 13B are views respectively developing planarly behaviors before and after operating the starter 1.

As is apparent also from FIG. 13A, before starting the starter 1, the shock absorbing member 65 is fitted in a space (main unmovable recessed portion 683) formed by the unmovable locking projection 681 and the unmovable contact projection 682 of the containing case 68 and the movable locking projection 641 of the cylindrical resin member 64. Further, the movable contact projection 642 of the cylindrical resin member 64 is loosely located in a space (sub unmovable recessed portion 684) between the unmovable locking projection 681 and another one of the unmovable contact projection 682 contiguous thereto.

Further, before operating the starter 1, the shock absorbing member 65 is not substantially compressed except a pre-compression amount in attaching the shock absorbing member 65. Also, the movable contact projection 642 is disposed at a position separated from the unmovable contact projection 682, that is, adjacent to the unmovable locking projection 681.

Meanwhile, when the starter 1 starts operation, the cylindrical resin member 64 receives the reaction force from the internal gear 649 in a direction denoted by an arrow A1 in FIG. 13B. By the reaction force, the movable locking projection 641 compresses the main elastic block portion 651 of the shock absorbing member 65 in the direction A1 of the reaction force.

In this embodiment, before starting the starter 1, the movable locking projection 641 and the main elastic block portion 651 are held in a state of being elastically in close contact with each other. Therefore, the reaction force applied to the cylindrical resin member 64 is gradually absorbed from the start by the main elastic block portion 651 via the movable locking projection 641. Accordingly, it is less likely that shock load or the like will be applied rapidly thereto.

Further, when the main elastic block portion 651 is compressed, the main unmovable recessed portion 683 achieves a function of a guide groove and the shock absorbing member 65 and the movable locking projection 641 are respectively guided thereby. Further, the sub unmovable recessed portion 684 achieves a function of a guide groove and the movable contact projection 642 is guided thereby.

When the reaction force is further increased and a compressed amount of the main elastic block portion 651 by the movable locking projection 641 reaches a vicinity of a limit (for example, compressed amount of 30%), the movable contact projection 642 rotated integrally with the movable locking projection 641 is brought into contact with the unmovable contact projection 682 of the fixed containing case 68 as in the state shown in FIG. 13B.

Then, thereafter, the cylindrical resin portion 64 cannot be rotated in the direction A1 of the reaction force. Thus, the compressed amount of the main elastic block portion 651 is restricted from exceeding the limit compressed amount (maximum compressed amount) by the movable locking projection 641.

Further, when the reaction force applied to the cylindrical resin member 64 is released after starting the engine, the shock absorbing member 65 and the cylindrical resin member 64 return from the state shown in FIG. 13B to the state shown in FIG. 13A. At this time, the movable locking projection 641 is reversely moved, that is, returned toward another unmovable contact projection 182 (to a bottom side of FIGS. 13A and 13B). However, inherently, the operated force is weak and the sub elastic block portion 152 is present between the movable locking projection 641 and the unmovable contact projection 182. Therefore, shock load or the like is hardly applied to respective portions at this time. Accordingly, it is less likely that unpleasant sound or the like will occur at the surrounding.

In the starter 1, the cylindrical resin member 64 of the reduction gear 10 is restricted from rotating at least in one direction by the rotation restricting means including the movable locking portion 641, the unmovable locking portion 681, and the shock absorbing member 65.

Further, the shock absorbing member 65 serves as vibration isolating member and therefore, can absorb vibration or sound generated at the reduction gear 10 or a surrounding thereof. In this way, the reduction gear 10 of the invention can sufficiently reduce vibration, unpleasant sound or the like generated in operating the starting apparatus although the reduction gear 10 is provided with a comparatively simple structure.

Meanwhile, the shock absorbing member 65 has an elastic projected portion 654 projecting from at least one side of the main elastic block portion 651 in the axial direction. The elastic projected portion 654 elastically holds the internal gear in the axial direction. That is, the elastic projected portion 654 serves as a thrust bearing of the cylindrical resin member 64. Further, vibration, deflection or the like of the internal gear 10 is restrained and therefore, a stable output at reduced speed is provided without bringing about wear or the like of the internal gear 649.

Further, the elastic projected portion 654 is projected from the axial end face of the main elastic block portion 651 and therefore, an area thereof in contact with a sliding wall disposed on the side in the axial direction of the shock absorbing member 65 is very small. Therefore, as compared with the case in which an axial side face of the elastic block portion is totally brought into slide contact with a wall face or the like of a case containing the elastic block portion, movement of the main elastic block portion 651 in compressing operation becomes very smooth. In addition thereto, since the elastic projected portion 654 is mainly slide contact with the sliding wall face or the like. Therefore, wear or deterioration of the first elastic block portion 651 and the like is reduced. Accordingly, reliability of the shock absorbing member 65 can be increased.

In consideration of various vibrations applied to the internal gear 649, integration tolerance and the like, it is preferable that the cylindrical resin member 64 is elastically held also in the axial direction. The shock absorbing member 65 has the elastic projected portions 654 projecting in the axial direction. Further, the elastic projected portions 654 are on the side of the unmovable locking projections 681. Therefore, the elastic projected portions 654 are not dragged when the movable locking portions 641 slide. Accordingly, the elastic projected portions 654 achieve stable holding function.

Further, since the elastic projected portions 654 have semispherical shapes and make point contact with an abrasive face, abrasion resistance is reduced. Therefore, the cylindrical resin member 64 is smoothly moved. Further, since the sliding area is small, wear and damage of the shock absorbing member 65 is decreased.

Further, by providing the elastic projected portions 654 on the first elastic block portion 651, rigidity of the first elastic block portion 651 at a vicinity thereof increases. With this, unexpected deformation of the elastic block portion 651, which is compressed in operating the starter 1, can be restrained and therefore, reliability of the shock absorbing member 65 is further increased.

Further, the rotation constraining unit includes the movable contact portion 642 and the unmovable contact portion 682. The movable contact portion 642 is arranged at a predetermined interval from the movable locking portion 641 and integrally pivoted with the movable locking portion 641. The unmovable contact portion 682 extends in the axial direction to be opposed to the movable contact portion 642, faces the movable contact portion 642 in the circumferential direction. The unmovable contact portion 682 is arranged in a state of being unmovable in the circumferential direction.

Thus, a compressed amount of the elastic block portion 651 by the movable locking portion 641 and the unmovable locking portion 681 can be restricted by bringing the movable contact portion 642 and the unmovable contact portion 682 into contact with each other.

In this structure, even when the large reaction force is applied to the internal gear 649, rotation of the cylindrical resin member 64 is restricted to a range until bringing the movable contact portion 642 into contact with the unmovable contact portion 682. Therefore, also a compressed amount of the elastic block portion 651 by the movable locking portion 641 and the unmovable locking portion 681 is restricted within a predetermined range. Thereby, destruction, damage, early fatigue or the like of the shock absorbing member 65 by an excessively large compressed amount can be decreased beforehand. Thus, reliability of the shock absorbing member 65 and therefore, reliability of the starter 1 is increased.

Further, even when large reaction force is applied to the internal gear 649, the movable contact portion 642 and the unmovable contact portion 682 are operated as a detent. Therefore, rotation of the internal gear 64 is restricted. Accordingly, an input from the drive motor 80 is efficiently speed reduced and outputted from the carrier 13.

Since the movable locking portion 641 and the unmovable locking portion 681 are elastically held by the elastic block portion 651, load is elastically and gradually applied to the movable locking portion 641 from the start of operation of the starter 1. Further, also when the elastic block portion 651 returns after starting the engine, force is gradually exerted to the movable locking portion 641.

Here, a state in which the elastic block portion 651 is elastically held between the movable locking portion 641 and the unmovable locking portion 681 is achieved by integrating the shock absorbing member 65 between the movable locking portion 641 and the unmovable locking portion 681 in a state that the shock absorbing member 65 is slightly compressed. In this way, the highly reliable and highly efficient starter 1 restraining unpleasant sound or the like is provided.

Further, the compressed amount (maximum compressed amount) allowed to the elastic block portion 651 can be easily set to change by adjusting an interval between the movable contact portion 642 and the unmovable contact portion 682. Thus, the reduction gear 10 has flexibility in designing.

As the shock absorbing member 65, a spring, synthetic resin, synthetic rubber or the like can be used. The elastic rubber block including synthetic rubber as in the embodiment has a degree of freedom of the shape. Thus, the elastic rubber is preferable in view of function, reliability, cost, integration performance or the like. Particularly, when the elastic block portion includes synthetic rubber, it is preferable that the movable contact portion 642 and the unmovable contact portion 682 are arranged such that a maximum compression rate thereof falls in a range of 10% through 30%.

A general allowable maximum compression rate of synthetic resin is normally set to be around 20% in consideration of durability thereof. In the case that the elastic block portion is used in a short period of time in starting the engine, even if the compression rate exceeds 20%, the reliability may not be deteriorated for a long period of time. However, when the compression rate exceeds 30%, the elastic block portion may be destructed or damaged.

Hence, in the embodiment, the compression rate is confined in 30%. Further, an upper limit of the compression rate can be easily restricted by the movable contact portion 642 and the unmovable contact portion 682. A lower limit of the compression rate is set to 10% for effectively utilizing elasticity of the elastic block portion.

An explanation has mainly been given of the case of compressing the main elastic block portion 651 by the movable locking portion 641. However, a direction of force applied to the movable locking portion 641 is changed before and after starting the engine. Therefore, the movable locking portion 641 and therefore, the internal gear 64 can be rotated in a direction opposite to the direction of the reaction force.

Here, the shock absorbing member 65 includes the main elastic block portion 651 and the sub elastic block portion 652 elastically held between the movable locking portion 641 and the unmovable contact portion 682 and the bridging portion 653 connecting the main elastic block portion 651 and the sub elastic block portion 652 to span the movable locking portion 641. Also, the ratio of the circumferential length of the main elastic block portion 651 as compared with that of the sub elastic block portion 652 is in a range of 4 through 6.

Thereby, the movable locking portion 641 is elastically held by the sub elastic block portion 652 even on the side opposite to the main elastic block portion 651. As a result, the movable locking portion 641 and therefore, the internal cylindrical resin member 649 are held in a state of being elastically held in both rotational directions thereof. Therefore, the movable locking portion 641 is in a state of being held further stably. Accordingly, unpleasant sound and vibrations reduce in the reduction gear 10. Further, since the main elastic block portion 651 and the sub elastic block portion 652 are connected by the bridging portion 653. Therefore, the shock absorbing member 65 is easily integrated. Further, it facilitates part control.

Here, the ratio of the circumferential length of the main elastic block portion 651 with respect to that of the sub elastic block portion 652 is made in the range of 4 through 6 because the force applied in a direction of compressing the main elastic block portion 651, that is, reaction force in starting, is larger than the force applied in a direction of compressing the sub elastic block portion 652, that is, the force opposite to reaction force.

In a case that the ratio of the circumferential length is less than 4, it is difficult to ensure durability of the main elastic block portion 651. Further, in a case that the ratio of the circumferential length exceeds 6, it is difficult to achieve compact formation. Here, the ratio of the circumferential length may be compared by lengths of center circle arcs of the main elastic block portion 651 and the sub elastic block portion 652.

The substantially center portion in the circumferential direction of the elastic block portion (main elastic block portion) 651 is constricted narrower than the end portion thereof. Therefore, the main elastic block portion 651 is compressible in the circumferential direction. Also, a deformation resistance is reduced at least at the constricted central portion. When the main elastic block portion 651 is compressed, the constricted portion is expanded to the surrounding.

Because a change of shape accompanied by the compression is brought about the constricted portion, elasticity of the elastic block portion is effectively utilized. Thus, the shock absorbing member 65 provides large shock absorbing function. Further, the main elastic block portion 651 is not constricted at an end portion thereof. Therefore, the main elastic block portion 651 is stably held at the end portions thereof by the movable locking portion 641 and the unmovable locking portion 681.

In the embodiment, a mode, a number or the like of the shock absorbing member 65 is not particularly limited. However, in order to achieve compact formation of the starter 1 and stable operation of the internal gear 649, it is preferable to arrange the shock absorbing members 65 respectively uniformly at three locations or more in the circumferential direction. Hence, it is preferable that three pairs or more of the movable locking portions 641 and the movable contact portions 642 and the unmovable locking portions 681 and the unmovable contact portions 682 are respectively arranged uniformly in the circumferential direction. Similarly, it is preferable that three or more pairs of the movable contact portions 642 and the unmovable contact portions 682 are arranged uniformly in the circumferential direction.

Thereby, inclination or deviation of the internal gear 64 in starting can be restrained and the smooth operation of the starting apparatus is ensured. Further, also reaction force in starting can be received by a plurality of the elastic block portions 651. Therefore, the shock absorbing member 65 can be downsized and stable shock absorbing function can be achieved.

The movable locking portion 641 and the movable contact portion 642 are integrally molded in the cylindrical resin member 64 having the bottom. Also, the internal gear 649 is formed in the inner cylindrical wall of the resin member 649. By integrating those members, part control or integration is facilitated. Further, even when the cylindrical resin member 64 has a complicated shape, it can be comparatively easily be provided at low cost by integral molding of resin.

Further, shock due to the reaction force applied to the internal gear 649 and the movable locking portion 641 can be sufficiently absorbed by the shock absorbing member 65. Therefore, even when the members are integrally molded by resin, the members are not destructed or damaged and are excellent in wear resistance and highly reliable.

Although the movable locking portions 641 and the movable contact portions 642 are rotated integrally with an internal gear 649, it is not always necessary that those members are integrated. For example, there may be established a locking relationship in which the movable locking portion 641 and the movable contact portion 642 of the internal gear are constituted by separate members and the both members are integrally rotated.

In this way, the starter 1 receives the reaction force, which is caused in operating the starter 1, by the shock absorbing member 65 while alleviating the reaction force. Further, the starter 1 reduces damage or the like of the shock absorbing member 65 and is still and highly reliable. Further, sufficient reliability is ensured even when the internal gear 649 made of resin is used.

In this description, "unmovable" state referring to the unmovable locking portion or the unmovable contact portion signifies that the portion is not substantially pivoted. It is, not used against play or vibrations. Further, the starter 1 is not limited to the gear type starter but may be other type of starter. Further, "circumferential direction" and "axial direction" are defined relative to a rotation center axis of the reduction gear 10.

The present invention should not be limited to the disclosed embodiments, but may be implemented in other ways without departing from the spirit of the invention.

What is claimed is:

1. A starting apparatus for starting an engine comprising:

a drive motor;

a housing; and a reduction gear including:

a sun gear disposed to rotate by receiving an input from the drive motor;

an internal gear arranged in the housing concentrically around the sun gear and movable in a circumferential direction with respect to the housing;

a planetary gear meshing with the sun gear and the internal gear;

a carrier rotatably supporting the planetary gear and outputting an input of the sun gear by reducing a speed thereof; and a rotation constraining unit to constrain movement of the internal gear, wherein the rotation constraining unit includes:

a first protruding portion integrated with the internal gear to move with the internal gear in the circumferential direction, the first protruding portion protruding in a first direction parallel to an axial direction;

a second protruding portion integrated with the housing to be unmovable in the circumferential direction with respect to the housing and opposed to the first protruding portion, the second protruding portion protruding in a direction directly opposite to the first direction;

a shock absorbing member, including a main elastic block portion that is elastically held between the first protruding portion and the second protruding portion, to receive a reaction force applied to the internal gear when the drive motor starts to rotate the engine via the reduction gear;

a first contact portion arranged at an interval from the first protruding portion in the circumferential direction and integrally movable with the first protruding portion; and a second contact portion arranged at an interval from the second protruding portion and disposed to be unmovable in the circumferential direction with respect to the housing, the second contact portion extending in the axial direction opposite to the first contact portion and opposing the first contact portion in the circumferential direction, wherein a compressing amount of the main elastic block portion due to a compressive force between the first protruding portion and the second protruding portion is restricted and a rotation of the internal gear is constrained when the first contact portion contacts the second contact portion.

2. The starting apparatus according to claim 1, wherein the shock absorbing member includes an elastic projected portion projecting from the main elastic block portion in an axial direction to elastically hold the internal gear in the axial direction.

3. The starting apparatus according to claim 2, wherein the elastic projected portion is provided on a side of the second protruding portion of the main elastic block portion.

4. The starting apparatus according to claim 1, wherein the main elastic block portion includes a synthetic rubber, and wherein the first contact portion and the second contact portion are arranged at positions such that a maximum compression rate of the main elastic block portion is in a range often percent through thirty percent.

5. The starting apparatus according to claim 1, wherein the shock absorbing member further includes a sub elastic block portion that is held between the first protruding portion and the second contact portion and a bridging portion that connects the main elastic block portion and the sub elastic block portion to span the first protruding portion.

6. The starting apparatus according to claim 5, wherein a ratio of a circumferential length of the main elastic block portion with respect to a circumferential length of the sub elastic block portion is in a range of four through six.

7. The starting apparatus according to claim 1, wherein a substantially central portion of the main elastic block portion in the circumferential direction is constricted narrower than an end portion thereof.

8. The starting apparatus according to claim 1, wherein the rotation constraining unit includes more than three pairs of the first protruding portion and the second protruding portion, wherein the pairs of the first protruding portion and the second protruding portion are arranged uniformly in the circumferential direction.

9. The starting apparatus according to claim 1, wherein the rotation constraining unit includes more than three pairs of the first contact portion and the second contact portion, wherein the pairs of the first contact portion and second contact portion are arranged uniformly in the circumferential direction.

10. The starting apparatus according to claim 1, wherein the internal gear, the first protruding portion and the first contact portion are constructed with a single resin member that is integrally molded by resin into substantially a cylindrical shape having a bottom, wherein the internal gear includes inner teeth formed on an inner cylindrical face of the resin member and the first protruding portion and the first contact portion respectively projecting from an outer bottom face of the resin member in the axial direction.

11. The starting apparatus according to claim 10, wherein the second protruding portion and second contact portion are included in a case arranged to oppose the outer bottom face of the resin member and its rotation is restricted, wherein the case has substantially a cylindrical shape having a bottom, the second protruding portion and the second contact portion project from a bottom face of the case in the axial direction toward the outer bottom face of the resin member, and the shock absorbing member is contained in a recessed portion provided inside of a cylindrical portion of the case.

12. The starting apparatus according to claim 1, wherein the first contact portion is positioned between the second contact portion and the second protruding portion in the circumferential direction, and the first protruding portion is positioned between the second protruding portion and the second contact portion in the circumferential direction.

13. A starting apparatus for starting an engine comprising:

a drive motor;

a reduction gear movable in accordance with operation of the drive motor, the reduction gear including at least an internal gear movable in a circumferential direction with respect to a housing; and a rotation constraining unit which constrains a movement of the internal gear, wherein the rotation constraining unit includes a first protruding portion integrated with the internal gear to move with the internal gear in the circumferential direction, the first protruding portion protruding in a first direction parallel to an axial direction, a second protruding portion integrated with the housing to be unmovable in the circumferential direction with respect to the housing and opposed to the first locking portion, the second protruding portion protruding in a direction directly opposite to the first direction, a first contact portion arranged at an interval from the first protruding portion in the circumferential direction and integrally movable with the first protruding portion, a second contact portion arranged at an interval from the second protruding portion and to be unmovable in the circumferential direction with respect to the housing, the second contact portion extending opposing the first contact portion in the circumferential direction, and a shock absorbing member which includes a first elastic block portion elastically held between the first and second protruding portions, a second elastic block portion elastically held between the first protruding portion and the second contact portion, and a bridging portion that connects the first and second elastic block portions to extend over the first protruding portion.

14. The starting apparatus according to claim 13, wherein a ratio of a circumferential length of the first elastic block portion with respect to a circumferential length of the second elastic block portion is in a range of four through six.

15. The starting apparatus according to claim 13, wherein a substantially central portion of the first elastic block portion in the circumferential direction is constricted narrower than an end portion thereof.

16. The starting apparatus according to claim 13, wherein the first elastic block portion, the second elastic block portion and the bridging portion are constructed by a single member.

17. The starting apparatus according to claim 13, wherein the first contact portion is positioned between the second contact portion and the second protruding portion in the circumferential direction, and the first protruding portion is positioned between the second protruding portion and the second contact portion in the circumferential direction.

18. A starting apparatus for starting an engine comprising:

a drive motor;

a reduction gear movable in accordance with operation of the drive motor, the reduction gear including at least an internal gear movable in a circumferential direction with respect to a housing; and a rotation constraining unit which constrains a movement of the internal gear, wherein the rotation constraining unit includes a first protruding portion integrated with the internal gear to move with the internal gear in the circumferential direction, the first protruding portion protruding in a first direction parallel to an axial direction;

a second protruding portion integrated with the housing to be unmovable in the circumferential direction with respect to the housing and opposed to the first portion, the second protruding portion protruding in a direction directly opposite to the first direction;

a shock absorbing member which is disposed to receive a reaction force applied to the internal gear when the drive motor starts to rotate the engine via the reduction gear, wherein:

the shock absorbing member has an elastic block portion elastically held between the first protruding portion and the second protruding portion; and a substantially central portion of the elastic block portion in the circumferential direction is narrower than an end portion thereof.

19. The starting apparatus according to claim 18, wherein:

the rotation constraining unit further includes a first contact portion arranged at an interval from the first protruding portion and integrally movable with the first protruding portion, and a second contact portion disposed to be unmovable in the circumferential direction with respect to the housing, the second contact portion extending opposing the first contact portion in the circumferential direction; and a compressing amount of the main elastic block portion due to the first protruding portion and the second locking portion is restricted when the first contact portion contacts the second contact portion.

20. The starting apparatus according to claim 19, wherein the first contact portion is positioned between the second contact portion and the second protruding portion in the circumferential direction, and the first protruding portion is positioned between the second protruding portion and the second contact portion in the circumferential direction.

* * * * *